US006427414B1

(12) United States Patent
Wing

(10) Patent No.: US 6,427,414 B1
(45) Date of Patent: Aug. 6, 2002

(54) DOVETAIL SIDING AND CORNER BLOCK ATTACHMENT METHOD

(76) Inventor: Jerold R Wing, P.O. Box 4511, Eagle, CO (US) 81631

( * ) Notice: Subject to any disclaimer, the term of this patent is extended or adjusted under 35 U.S.C. 154(b) by 0 days.

(21) Appl. No.: 09/662,562

(22) Filed: Sep. 15, 2000

(51) Int. Cl.[7] ..... E04B 2/08

(52) U.S. Cl. ..... 52/590.1; 52/590.1; 52/233; 20/4

(58) Field of Search ..... 52/233

(56) References Cited

U.S. PATENT DOCUMENTS

| | | | | | |
|---|---|---|---|---|---|
| 1,996,735 | A | * | 4/1935 | King | 20/4 |
| 4,277,925 | A | | 7/1981 | Kinser | 52/233 |
| 4,320,610 | A | | 3/1982 | Rupp | 52/233 |
| 4,627,204 | A | | 12/1986 | Smith | 52/233 |
| 4,840,003 | A | * | 6/1989 | Lucas et al. | 52/233 |
| 4,878,328 | A | * | 11/1989 | Berge | 52/233 |
| 5,167,103 | A | | 12/1992 | Lindal | 52/284 |
| 5,577,357 | A | | 11/1996 | Civelli | 52/233 |
| 5,638,649 | A | | 6/1997 | Hovland | 52/233 |
| 6,000,177 | A | | 12/1999 | Davi | 52/233 |

* cited by examiner

*Primary Examiner*—Carl D. Friedman
*Assistant Examiner*—Steve Varner

(57) ABSTRACT

A building structure having a plurality of alternating siding boards and corner blocks that simulate a hewn log building with dovetail notches and the method of application are disclosed. The corner blocks and siding boards are pre-formed to fit snugly together at the structure's corner and are attached by wood splines and exterior wood glue. A three legged fastener or "h" clip attaches the siding units to the sheathing in the chink joint. The siding can be speedily erected at the site with a minimum of field cutting on either new or existing buildings.

6 Claims, 3 Drawing Sheets

Fig. #1

DOVETAIL SIDING AND CORNER BLOCK ATTACHMENT METHOD

CROSS REFERENCES TO RELATED APPLICATIONS

Not applicable.

BACKGROUND—FIELD OF INVENTION

This invention relates to hewn log siding, specifically to the joining of horizontal siding boards with matching corner blocks.

BACKGROUND—DESCRIPTION OF PRIOR ART

Buildings built of hewn logs are traditional in many parts of the world. In such buildings, logs are laid one upon the other in courses, and may comprise both the wall structure and the interior and exterior finish to the building.

More recently, frame construction has supplanted the log, in terms of wall structure, while profiled boards having a psuedo log-look are used for external finish. While a sheathing of horizontally set hewn log-look boards conveys an impression much akin to an original solid log structure, the corner treatment, in order to achieve an authentic log appearance, has proved bothersome.

A prior solution has been the attachment of solid log sections to the sheathing boards at the building corner. This method proved time consuming and costly since each segment of "log" had to be profiled to provide a close fit with its respective siding piece.

Another solution was the installation of vertical corner posts connecting to horizontal siding, U.S. Pat. No. 4,277,925 to C. Wayne Kinser (Jul. 14, 1981) and U.S. Pat. No. 5,167,103 to Ronald J. Lindal, Benjamin H. Lindal (Dec. 12, 1992). However, this solution did not provide woodgrain patterns that closely mimic true log construction.

S. S. King U.S. Pat. No. 1996735 (Apr. 2, 1935) relates to construction with horizontal siding units and corner blocks made to resemble saddle-V notches. The siding was nailed both to the frame and to the corner block and the joint between the corner block and siding was a mitered 45-degree angle, which chips out in the ingrain block.

SUMMARY

In a building wall structure having outer walls and corners that simulate hewn log construction a log siding system comprising: a foundation, a plurality of siding units made to simulate hewn logs secured alternatively to one and then the other of the walls that unite to form a corner of the structure spaced one from the other by a chink joint, the siding unit comprising: a siding board of plain lumber and predetermined dimensions made to simulate the outside of a log and a wood corner block of predetermined dimensions made to simulate the end of a log, the siding board having a cutout at the interior facing extremity to accept the corner block, the siding board and corner block being attached perpendicularly at the cutout with wood glue so when the siding board lies against one wall the block will lie against the other wall, the corner block having a chamber cut around the exterior facing edges, whereby attaching the siding board and the corner block without external fasteners, allowing the natural woodgrain patterns to run uninterrupted, and camouflaging and protecting the joint from elemental assault.

OBJECTS AND ADVANTAGES

It is, therefore, an object of the invention to give the illusion of hewn log construction, with dovetail notches at the ends of logs and caulking between adjacent logs, to buildings with the use of standardized siding components.

It is also an object of the present invention to enable this hewn log siding to be applied to any type of preconstructed wall that is flat, whether new construction or existing.

It is a further object of the invention are to provide a method for attaching standardized corner blocks to horizontal siding while retaining realistic and authentic woodgrain patterns and corner profile.

Another object is to provide a joint between siding and corner block that will withstand both time and elemental forces.

It is still another object of the invention to provide a method for attaching the siding and corner pieces both together and to the building without the use of visible external fasteners.

Another object of the invention is to provide a siding that retains the look and feel of hewn log while incorporating all the structural and insulation advantages of frame construction.

A still further object of the present invention is to provide a system and/or method for the fabrication of a simulated log-type building structure.

Still further objects and advantages will become apparent from a consideration of the ensuing description and accompanying drawings.

REFERENCE NUMERALS

Figure 1:
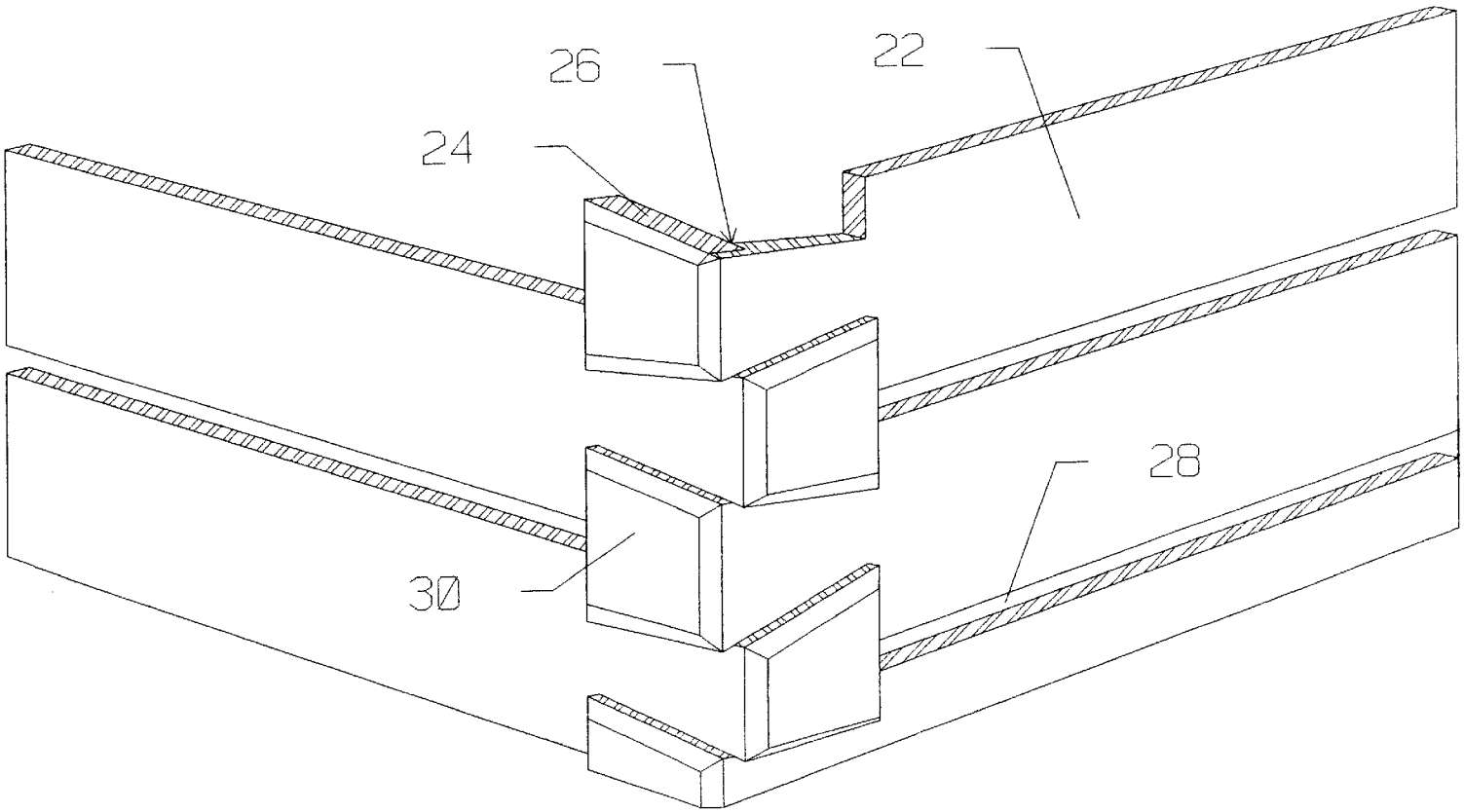
FIG. 1 is a perspective view of a partial front and side of a simulated log structure having the unique building features of the present invention.

22 siding board
24 corner blocks
26 siding unit
28 chink joint
30 corner block end portion
32 wood splines
34 exterior wood glue
36 wood screws
38 cutout
40 chamber
42 sheathing
44 "h" clip
46 groove

PREFERRED EMBODIMENT—DESCRIPTION

FIG. 1 illustrates a simulated log structure that is produced by this method from two structural elements or components forming a part of this invention. The structure includes a plurality of spaced log facing boards or siding boards 22 as its first element, with thicker corner blocks 24 as the second element. In combination, these two elements form a complete siding unit 26. A gap or chink joint 28 is left between the siding boards to be caulked upon completion of the siding installation. The siding boards and the corner blocks form an interlocking compound dovetail joint at the corner of the log structure with right-hand siding units from one wall alternating with left-hand siding units from the adjacent wall to simulate the log-upon-log method used in true hewn log construction. Siding boards 22 are attached to their respective corner blocks 24 where they embrace the structure's corner. Both siding boards 22 and corner blocks 24 may be mutilated to simulate the surface of a hewn log and the edges rounded slightly to resemble the upper and lower surfaces of hewn logs.

The simulated dovetail or wedge-shaped corner is formed from alternating right-hand and left-hand siding units 26, whose corner blocks 24 have two opposite parallel sides with any two of the abutting sides forming a substantially right angle, and two of the opposite sides being wider than the other two opposite sides to form in cross-section a rectangular portion. A corner block end face 30 exhibits endgrain, and the right-hand corner block end portions and the left-hand corner block end portions are at an equal angle to each other with the angle of one end face being disposed 90 degrees to the angle of the opposite end face. The angular relationship of the end face in each set of corner blocks is such that it is downwardly depending across the wide end of the corner block at one end and downwardly depending across the narrow end of the corner block at the other end. Assembling alternating right-hand siding units and left-hand siding units produces the dovetail corner with the appearance of crossed, interlocked, and socketed log ends at the corner where the two walls of the structure meet (see FIG. 1).

Figure 2:
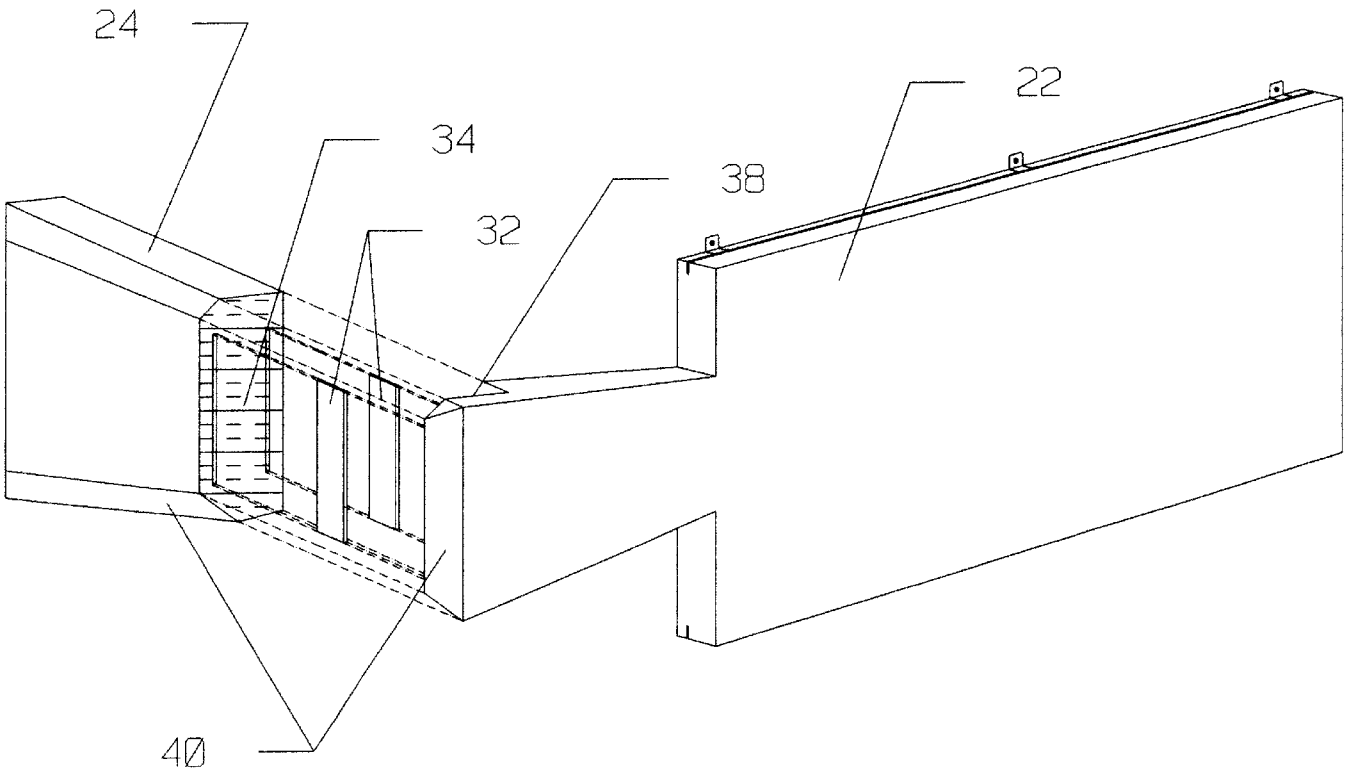
FIG. 2 is an exploded view of a plan of a unit consisting of a length of siding secured to a block to simulate the projecting end of a hewn log at the structure corner.

FIG. 2 shows a unit consisting of a siding board 22, to one end of which is secured a thicker corner block 24. In the preferred embodiment, the siding board is joined to corner block 24 by wood splines 32 and exterior wood glue 34. As shown, the extremity of the siding board contains a recess or cutout 38, which is the depth of the corner block and approximately half the thickness of the siding board, to accept the corner block. A chamber 40 is cut around the edges of the corner block end face.

Figure 3:
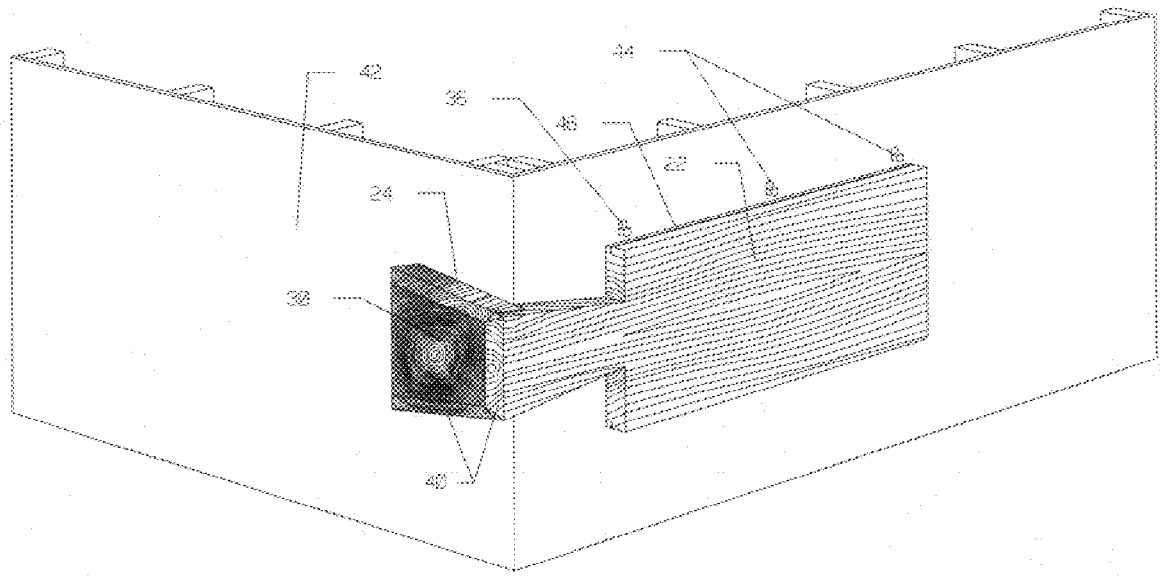
FIG. 3 is a view of a siding unit comprising a siding board and a corner bock attached with wood glue and spines that is attached to the sheathing.

FIG. 3 shows the preferred method for attaching the siding boards and the corner blocks to sheathing 42. An "h" clip 44, having two legs on one side and one on the other side, is used to secure the siding board to the sheathing. A notch or groove 46 is cut into the siding board top and bottom and the bottom right or unopposed leg of "h" clip 44 is placed into groove 46 while the bottom left leg of "h" clip 44 is placed between the siding board and the sheathing. The remaining leg, upper left, of "h" clip 44 now lays flat against the sheathing and is screwed into the sheathing with wood screws 36.

PREFERRED EMBODIMENT—OPERATION

Referring first to FIG. 3, a siding board 22 may typically be of spruce or pine having a nominal 14 inch width, one and three quarters inch nominal thickness. However, the siding boards may be formed from any suitable wood or standard sized board. A corner block 24 is cut from the same wood as the siding boards to continue the illusion of continuous logs and is preferably about twice the thickness of the siding boards.

FIG. 2 shows an exploded view of the joint between siding board 22 and corner block 24. The recess or cutout 38 in the siding board is preferably rabbetted out to accept the corner block. Then, a slot is cut into both siding board 22 and corner block 24 of the appropriate size for wood splines 32, at corresponding locations. Exterior wood glue 34 is then applied to the joint surface between siding board 22 and corner block 24 as well as the slots prepared for wood splines 32. The siding board and corner block are then secured together by clamps until exterior wood glue 34 has dried.

The use of exterior wood glue 34 and wood splines 32 both weatherproof and permanently secure the joint. As shown in FIG. 3, the joint between the siding board and the corner block is camouflaged by a chamber 40 that is cut on corner block end face 30. The chamber may also be continued along the siding unit 26 to form the "log" edges bounding the exterior face, which may be hacked or chiseled to resemble a hewn log. Once completed, the siding unit is preferably treated for exterior use to make it resistant to moisture, mildew, and insects. Siding units 26 may also be treated with exterior wood stain if desired.

As shown in FIG. 3, "h" clip 44 is used in combination with groove 46 to secure siding unit 26 to sheathing 42. The "h" clips are positioned above and below siding boards 22 in order to pinch the siding boards and secure them against the sheathing. "h" clip 44 may also be used to secure the corner blocks to the sheathing. Fastening in this manner allows installation without visible traces on either new or existing structures since groove 46 and the visible portions of "h" clip 44 and wood screw 36, that are in the chink joint, will be covered by chinking. In addition, there is no exposed opening into the siding board or the corner block for water to enter. Following installation of the siding units, the structure is chinked in chink joint 28.

Conclusions, Ramifications, and Scope

Accordingly, it can be seen that the invention provides a hewn log siding that closely simulates true hewn log construction. The standardized hewn log siding is able to withstand the elements, attaches without visible fasteners on new and existing structures, exhibits natural woodgrain patterns and corner profile, and retains the benefits of frame construction.

Although the description above contains many specificities, these should not be construed as limiting the scope of the invention but as merely providing illustrations of some of the presently preferred embodiments of this invention. Various other embodiments and ramifications are possible within its scope. For example, a siding board 22 and corner block 24 may be constructed of any desired wood or dimension. Fiberglass mesh may be used to reinforce the attachment of corner block 24 to siding board 22. A galvanized steel bracket bent at a 90-degree angle might also be attached to the backside of corner block 24 and siding board 22 to prevent the endgrain block from being split off. The siding board may be applied with either toe screws or trim nails as well as back screwing through the sheathing. The cutout 40 in the siding board to accept the corner block may be made by other means or device. The "h" clip may be of any suitable size and of any suitable material that is impervious to weather. The use of other notch designs at the corner of the structure may also be employed.

Thus the scope of the invention should be determined by the appended claims and their legal equivalents, rather than by the examples given.

What is claimed is:

1. In a building wall structure having outer walls and corners that simulate hewn log-type construction comprising:

a foundation, a plurality of siding units made to simulate hewn logs secured alternatively to one and then the other of the walls that unite to form a corner of the structure spaced one from the other by a chink joint, said siding units each comprising:

a siding board of plain lumber and predetermined dimensions made to simulate the outside of a log and a wood corner block of predetermined dimensions made to simulate the end of a log, said boards, each having a cutout at the interior facing extremity to accept said block, said boards and said blocks being attached perpendicularly at the cutout with wood glue, so when the siding lies against one wall the block will lie against the other wall, said blocks having a chamber cut around the exterior facing edges, whereby attaching said board and said block without external fasteners, allowing natural woodgrain patterns to run uninterrupted, and camouflaging and protecting the joint from elemental assault.

2. The building structure of claim 1 in which said board and said block are attached with a wood spline.

3. The building structure of claim 1 in which said board and said block are attached with a galvanized steel bracket.

4. The building structure of claim 1 in which said siding units contain a groove along the top and bottom and are attached to a sheathing with a plurality of three legged "h" clips, a bottom right leg of which clip fits into said groove, a bottom left leg of which clip sandwiches between said siding unit and said sheathing, and a top left leg of which clip lies flat against said sheathing and is secured there in said chink joint, whereby said siding unit is securely fastened to said structure without external traces when said chink joint is chinked.

5. The building structure of claim 1 in which said siding units are fashioned to simulate a corner joint pattern selected from the group consisting of dovetails and compound dovetails.

6. In a corner of a building structure, a series of siding units, each unit comprising a siding board made to simulate the outside of a log and a corner block made to simulate the end of a log, said units being made to simulate the interlocked ends of logs at the corner of a log building, said boards being spaced by a chink joint, the improvement comprising a cutout in said siding board, said cutout parallel to said siding board, at the interior facing extremity of said siding board, said cutout of a size to accept said block, said boards and said blocks being attached perpendicularly at said cutout by a means for joining said boards and said blocks, said blocks having a chamber cut around the exterior facing edges whereby camouflaging the joint and allowing natural woodgrain patterns run uninterrupted.

* * * * *